US009422833B2

(12) United States Patent
Hayman et al.

(10) Patent No.: US 9,422,833 B2
(45) Date of Patent: Aug. 23, 2016

(54) CAMSHAFT ASSEMBLY FOR AN INTERNAL COMBUSTION ENGINE

(71) Applicant: GM GLOBAL TECHNOLOGY OPERATIONS LLC, Detroit, MI (US)

(72) Inventors: Alan W. Hayman, Romeo, MI (US); Robert S. McAlpine, Lake Orion, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 19 days.

(21) Appl. No.: 14/551,210

(22) Filed: Nov. 24, 2014

(65) Prior Publication Data

US 2016/0146062 A1 May 26, 2016

(51) Int. Cl.
*F01L 1/34* (2006.01)
*F01L 1/047* (2006.01)
*F01L 1/08* (2006.01)

(52) U.S. Cl.
CPC .. *F01L 1/047* (2013.01); *F01L 1/08* (2013.01)

(58) Field of Classification Search
CPC ..... F01L 1/08; F01L 1/047
USPC ..... 123/90.16, 90.18, 90.6
See application file for complete search history.

(56) References Cited

U.S. PATENT DOCUMENTS 8,863,714 B1 * 10/2014 Moran ..... F01L 13/0036 123/90.16

* cited by examiner

*Primary Examiner* — Ching Chang
(74) *Attorney, Agent, or Firm* — Quinn Law Group, PLLC

(57) ABSTRACT

A camshaft assembly for an internal combustion engine includes a camshaft, a first lobe set, and a second lobe set, extending along, and rotatable about, a cam axis. The first lobe set includes a first, second, and third lobe. The second lobe set includes a first and second lobe. The first lobe set is movable along the cam axis between a first, second, and third position. The second lobe set is movable along the cam axis between a first and second position. The first and second position of each of the first and second lobe sets corresponds to lift of a respective valve stem in the engine. The third position of the first lobe set corresponds to zero lift of the respective valve stem to provide cylinder deactivation of a corresponding cylinder within the engine.

20 Claims, 2 Drawing Sheets

CAMSHAFT ASSEMBLY FOR AN INTERNAL COMBUSTION ENGINE

TECHNICAL FIELD

The disclosure generally relates to a camshaft assembly for an internal combustion engine.

BACKGROUND

Internal combustion engines (ICE) are often called upon to generate considerable levels of power for prolonged periods of time on a dependable basis. Many such ICE assemblies employ a supercharging device, such as an exhaust gas turbine driven turbocharger, to compress the airflow before it enters the intake manifold of the engine in order to increase power and efficiency.

Specifically, a turbocharger is a centrifugal gas compressor that forces more air and, thus, more oxygen into the combustion chambers of the ICE than is otherwise achievable with ambient atmospheric pressure. The additional mass of oxygen-containing air that is forced into the ICE improves the engine's volumetric efficiency, allowing it to burn more fuel in a given cycle, and thereby produce more power.

Additionally, ICE's are being methodically developed to consume smaller amounts of fuel. Various technologies are frequently incorporated into ICE's to generate on-demand power, while permitting the subject engine to operate in a more fuel-efficient mode. Such fuel saving technologies may shut off operation of some of the engine's cylinders when engine power requirement is reduced and even completely stop the engine when no engine power is required.

SUMMARY

A vehicle includes an internal combustion engine. The internal combustion engine includes an engine block, a plurality of valve stems, a first camshaft assembly, and a second camshaft assembly. The engine block defines a first set of cylinders and a second set of cylinders. The valve stems are configured to provide selective fluid communication with the first and second set of cylinders.

The first camshaft assembly and a second camshaft assembly each extend along, and are each rotatable about, a respective cam axis. The first and second camshaft assembly are each disposed in operative communication with at least one of the valve stems.

The first camshaft assembly is configured to provide lift to at least one of the respective valve stems to selectively allow air to enter at least one of the first and second set of cylinders in response to rotation of the first camshaft assembly about the respective cam axis. Likewise, the second camshaft assembly is configured to provide lift to the respective valve stems to selectively allow air to exit at least one of the first and second set of cylinders in response to rotation of the second camshaft about the respective cam axis.

Each camshaft assembly is configured to provide lift to at least one of a plurality of valve stems to selectively allow air to respectively enter and exit at least one of the first and second set of cylinders.

Each camshaft assembly includes a camshaft, a first lobe set, and a second lobe set. The camshaft extends along, and is rotatable about, a cam axis. The first lobe set is operatively attached to the camshaft such that the first lobe set surrounds the cam axis. The first lobe set includes a first lobe, a second lobe, and a third lobe. The first lobe, the second lobe, and the third lobe of the first type of first lobe set each have a different profile from one another. The first lobe set is movable along the cam axis between a first position, a second position, and a third position. The first position of the first lobe set corresponds to selection of the first lobe so that lift is provided to the respective valve stem as a function of the profile of the first lobe of the first lobe set as the camshaft rotates about the cam axis. The second position corresponds to selection of the second lobe so that lift is provided to the respective valve stem as a function of the profile of the second lobe of the first lobe set as the camshaft rotates about the cam axis. The third position corresponds to selection of the third lobe so that lift is provided to the selective valve stem of the first lobe set as the camshaft rotates about the cam axis.

The second lobe set is operatively attached to the camshaft such that the second lobe set surrounds the cam axis. The second lobe set includes a first lobe and a second lobe such that the second lobe set includes a fewer number of lobes than the first lobe set. The first lobe and the second lobe of the second lobe set each have a different profile from one another. The second lobe set is movable along the cam axis between a first position and a second position. The first position corresponds to selection of the first lobe so that lift is provided to the respective valve stem corresponding to the profile of the first lobe of the second lobe set as the camshaft rotates about the cam axis. The second position corresponds to selection of the second lobe so that lift is provided to the respective valve stem of the second lobe of the second lobe set as the camshaft rotates about the cam axis.

The above features and advantages and other features and advantages of the present disclosure are readily apparent from the following detailed description of the best modes for carrying out the disclosure when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the disclosure, as defined by the appended claims.

Figure 1:
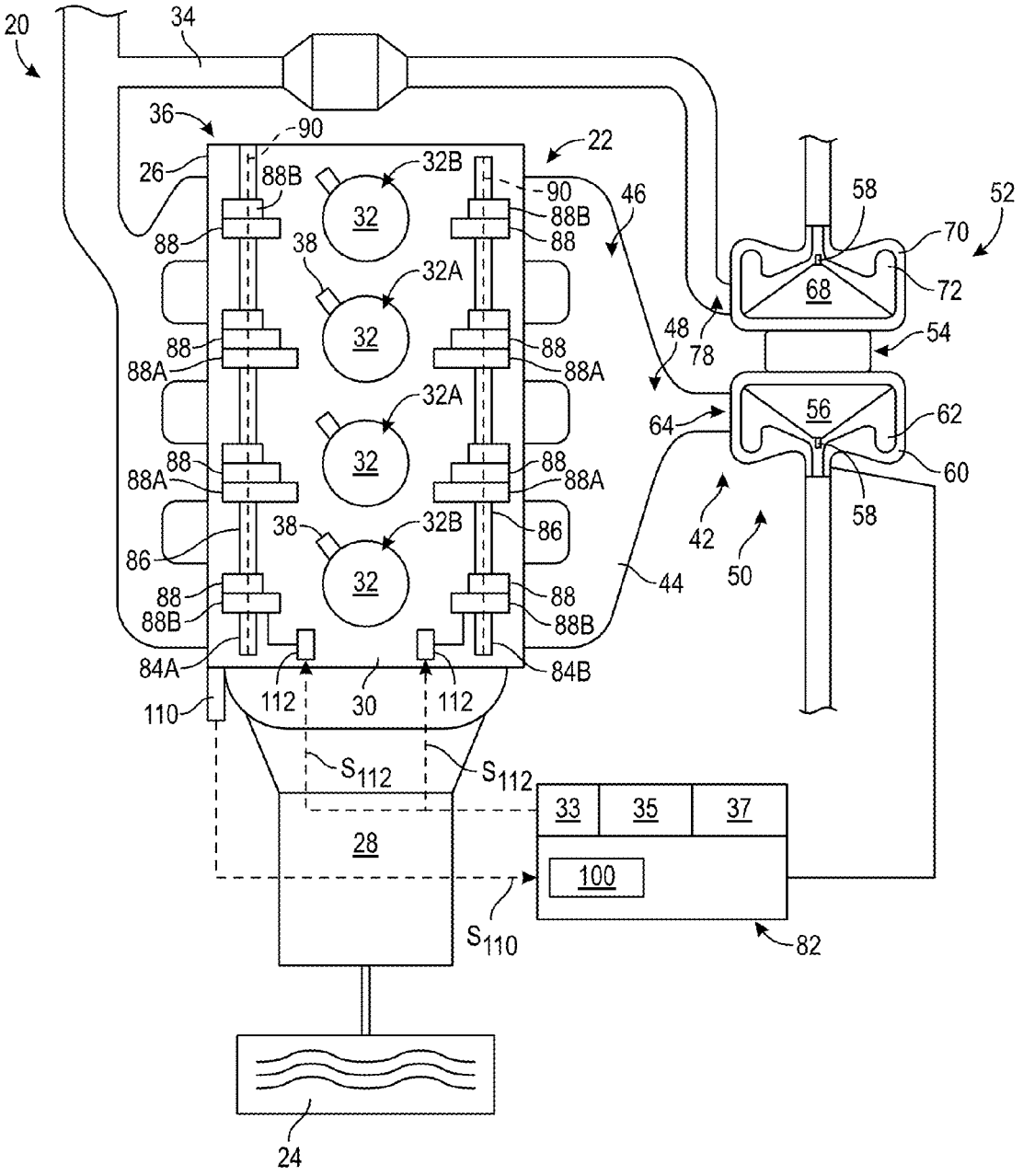
FIG. 1 is a schematic diagrammatic block diagram of a vehicle including an internal combustion engine with a single scroll turbocharger.

Referring to the Figures, wherein like numerals indicate like parts throughout the several views, FIG. 1 illustrates a vehicle 20 employing a powertrain 22 for propulsion thereof via driven wheels 24. As shown, the powertrain 22 includes an internal combustion engine 26, such as a spark- or compression-ignition type, and a transmission assembly 28 operatively connected thereto. The powertrain 22 may also include one or more electric motor/generators, none of which are shown, but the existence of which may be envisioned by those skilled in the art.

With continued reference to FIG. 1, the engine 26 includes a cylinder block 30 with a plurality of cylinders 32 arranged therein and a cylinder head 31 that is coupled to the cylinder block 30. The cylinder head 31 may be integrated into or cast together with the cylinder block 30. The cylinder head 31 receives air and fuel from an intake system 36 to be used inside the cylinders 32 for subsequent combustion. The air and fuel or air alone is admitted into the cylinder head 31 for each individual cylinder 32 via appropriately configured valve(s) that are not shown, but known to those skilled in the art.

The cylinders 32 are separated into a first cylinder or set of cylinders 32A and a second cylinder or set of cylinders 32B. The engine 26 also includes a mechanism 38 configured to selectively activate and deactivate the first set of cylinders 32A during operation of the engine 26.

Each cylinder 32 includes a piston, which is not specifically shown, but known to those skilled in the art to reciprocate therein. Combustion chambers, which are not specifically shown, but known to those skilled in the art, are formed within the cylinders 32 between the bottom surface of the cylinder head 31 and the tops of the pistons. As known by those skilled in the art, each of the combustion chambers receive fuel and air from the cylinder head 31 that form a fuel-air mixture for subsequent combustion inside the subject combustion chamber. Each cylinder 32 includes an intake valve and an exhaust valve, which are not specifically shown, but known to those skilled in the art to respectively provide air to, and exhaust gasses from, the respective combustion chamber. Although an in-line four-cylinder engine is shown, nothing precludes the present disclosure from being applied to an engine having a different number and/or arrangement of cylinders.

In the case of the in-line four-cylinder engine 26 depicted in the figures, the first set of cylinders 32A may include two individual cylinders, while the second set of cylinders 32B may include the remaining two individual cylinders. The deactivation of the first set of cylinders 32A via the mechanism 38 is intended to permit the engine 26 to operate on only the second set of cylinders 32B when a load on the engine 26 is sufficiently low so that power from both the first and second sets of cylinders 32A, 32B is not required drive the vehicle 20. For example, such low load operation may take place when the vehicle 26 is cruising at a steady state highway speed and the engine 26 is mostly used to overcome air drag and rolling resistance of the vehicle 20. Accordingly, operation of the engine 26 on solely the second set of cylinders 32B permits reduced consumption of fuel when engine power from the first set of cylinders 32A is not required to drive the vehicle 20.

The engine 26 also includes a crankshaft (not shown) configured to rotate within the cylinder block. As known to those skilled in the art, the crankshaft is rotated by the pistons, as a result of an appropriately proportioned fuel-air mixture being burned in each combustion chamber. After the air-fuel mixture is burned inside a specific combustion chamber, the reciprocating motion of a particular piston serves to exhaust post-combustion gasses from the respective cylinder 32. The cylinder head 31 is also configured to exhaust post-combustion gasses from the combustion chambers to an exhaust system 42 via an exhaust manifold 44. As shown in FIG. 1, the exhaust manifold 44 may be internally cast, i.e., integrated, into the cylinder head 31. The exhaust manifold 44 defines at least part of a passage 46 that is in fluid communication with the cylinder head 31. The first set of cylinders 32A and the second set of cylinders 32B discharge the post-combustion gasses into the passage 46. The passage 46 includes an outlet 48 defined by the exhaust manifold 44. Accordingly, the post-combustion gasses from each of the first and second sets of cylinders 32A, 32B may exit the exhaust manifold 44 via the outlet 48.

The engine 26 also includes a turbocharging system 50 configured to develop boost pressure, i.e., pressurize an airflow that is received from the ambient, for delivery to the cylinders 32. The turbocharging system 50 is configured as a single-stage forced induction arrangement for the engine 26. The turbocharging system 50 includes a turbocharger 52 that is in fluid communication with the passage 46 and configured to be driven by the post-combustion gasses from the outlet 48. The turbocharger 52 pressurizes and discharges the airflow to the cylinder head 31, via passage 34. When the first set of cylinders 32A are deactivated via the mechanism 38, the turbocharger 52 can be driven by the post-combustion gasses from only the second set of cylinders 32B and supply the pressurized airflow to feed the second set of cylinders 32B for combustion with an appropriate amount of fuel therein.

The turbocharger 52 includes a rotating assembly 54. The rotating assembly 54 includes a turbine wheel 56 mounted on a shaft 58. The turbine wheel 56 is rotated along with the shaft 58 by the post-combustion gasses. The turbine wheel 56 is disposed inside a turbine housing 60. The turbine housing 60 includes an appropriately configured, i.e., designed and sized, turbine volute or scroll 62, a relatively high-pressure inlet 64, and a relatively low-pressure outlet (not shown in detail, but known to those skilled in the art), that, along with the turbine wheel 56, provides a turbine subassembly, a.k.a., a turbine. The turbine scroll 62 of the turbine housing 60 receives the post-combustion gasses and directs the gasses to the turbine wheel 56. The turbine scroll 62 is configured to achieve specific performance characteristics, such as efficiency and response, of the turbocharger 52.

The rotating assembly 54 also includes a compressor wheel 68 mounted on the shaft 58. The compressor wheel 68 is configured to pressurize the airflow being received from the ambient for eventual delivery to the cylinders 32. The compressor wheel 68 is disposed inside a compressor cover 70. The compressor cover 70 includes a compressor volute or scroll 72, a relatively low-pressure inlet (not shown in detail, but known to those skilled in the art), and a relatively high-pressure outlet 78, that, along with the compressor wheel 68, generates a compressor subassembly, a.k.a., a compressor. As understood by those skilled in the art, the variable flow and force of the post-combustion gasses influences the amount of boost pressure that may be generated by the compressor wheel 68 of the turbocharger 52 throughout the operating range of the engine 26.

Additionally, referring again to FIG. 1, the vehicle includes a programmable controller 82 configured to regulate operation of the engine 26, such as by controlling an amount of fuel being injected into the cylinders 32 for mixing and subsequent combustion with the pressurized airflow. The physical hardware embodying the controller may include one or more digital computers having a processor 33 and a memory 35, e.g., a read only memory (ROM), random access memory (RAM), electrically-programmable read only memory (EPROM), high speed clock, analog to digital (A/D) and digital to analog (D/A) circuitry, and input/output circuitry and devices (I/O) including one or more transceivers 37 for receiving and transmitting any required signals in the executing of a method, as well as appropriate signal conditioning and buffer circuitry. Any computer-code resident in the controller or accessible thereby, including the algorithm, can be stored in the memory and executed via the processor(s) to provide the functionality set forth below.

The controller 82 of FIG. 1 may be configured as a single or a distributed control device. The controller 82 is electrically connected to, or otherwise in hard-wired or wireless communication with, the engine 26 via suitable control channels, e.g., a controller area network (CAN) or serial bus, including for instance any required transfer conductors, whether hard-wired or wireless, sufficient for transmitting and receiving the necessary electrical control signals for proper power flow control and coordination aboard the vehicle 20.

Figure 2:
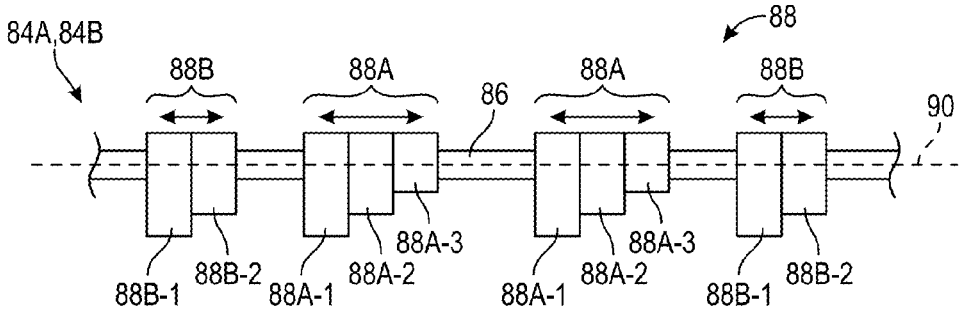
FIG. 2 is a schematic side view of a camshaft assembly of the internal combustion engine of FIG. 1.

With reference to FIGS. 1 and 2, the engine 26 includes a first camshaft assembly 84A and a second camshaft assembly 84B. Each camshaft assembly 84A, 84B includes a camshaft 86 and a plurality of lobe sets 88 operatively attached to the camshaft 86. Each camshaft 86 is rotatable about a respective cam axis 90. The lobe sets 88 may be slidably attached to the camshaft 86 for axial movement along the camshaft 86, and for rotation with the camshaft 86 about the cam axis 90.

For a four-cylinder engine 26, each camshaft assembly 84A, 84B includes two types of lobe sets 88, i.e., a first lobe set 88A and a second lobe set 88B. The first lobe set 88A corresponds to the first set of cylinders 32A and the second lobe set 88B corresponds to the second set of cylinders 32B. A pair of the first lobe sets 88A corresponds to the pair of the first set of cylinders 32A and a pair of the second lobe sets 88B corresponds to the pair of the second set of cylinders 32B. As such, for each camshaft assembly 84A, 84B, each one of the first and second type lobe sets 88A, 88B corresponds to a respective one of the four cylinders 32. It should be appreciated, however, there may be more or less lobe sets 88A, 88B, so as to correspond to a respective number of cylinders 32 in the engine 26.

Referring specifically to FIG. 2, each lobe set 88A, 88B includes a plurality of lobes. The plurality of lobes of the first lobe set 88A includes a first lobe 88A-1, a second lobe 88A-2, and a third lobe 88A-3. Likewise, the plurality of lobes of the second lobe set 88B includes only a first lobe 88B-1 and a second lobe 88B-2. Each of the first, second, and third lobes 88A-1, 88A-2, 88A-3 defines a different profile from one another, which is perpendicular to the cam axis 90. Similarly, each of the first and second lobes 88B-1, 88B-2 defines a different profile from one another. The respective lobes 88A-1, 88A-2, 88A-3 of the first lobe set 88A and the respective lobes 88B-1, 88B-2 of the second lobe set 88B are arranged in series along the cam axis 90. Referring to FIGS. 1 and 2, the first lobe sets 88A may be arranged adjacent one another on the cam axis 90 such that the first lobe sets 88A are sandwiched between the second lobe sets 88B. Alternatively, the second lobe sets 88B are arranged adjacent one another on the cam axis 90 such that the second lobe sets 88B are sandwiched between the first lobe sets 88A. Further, it should be appreciated that the profile of the first lobes 88A-1, 88B-1 of the types of the lobe sets 88A, 88B may be identical to one another and the profile of the second lobes 88A-2, 88B-2 of the types of lobe sets 88A, 88B may be identical to one another.

The intake valves are configured to selectively move to an open position, in response to actuation by one of the lobes 88A-1, 88A-2, 88B-1, 88B-2 of a respective lobe set 88A, 88B, and thereby allow air into the respective cylinder 32. Likewise, the exhaust valve stem is configured to selectively move to an open position, in response to actuation by one of the lobes 88A-1, 88A-2, 88B-1, 88B-2 of a respective lobe set 88A, 88B, and thereby exhaust gasses from the cylinder 32.

For the first lobe set 88A and the second lobe set 88B, the profile of each of each first lobe 88A-1, 88B-1 is configured to provide a maximum lift and the profile of each second lobe 88A-2, 88B-2 is configured to provide a minimum lift. For the first lobe set 88A, the profile of each third lobe 88A-3 is configured to provide zero lift.

Each lobe set 88A, 88B is movable along the respective cam axis 90, relative to the camshaft 86, between a number of positions corresponding to the number of lobes in the respective lobe set 88A, 88B. Therefore, the first lobe set 88A is configured to move along the cam axis 90 between a first position 92A, a second position 92B, and a third position 92C. The first position 92A corresponds to the selection of the first lobe 88A-1, the second position 92B corresponds to the selection of the second lobe 88A-2, and the third position 92C corresponds to the selection of the third lobe 88A-3. Likewise, the second lobe set 88B is configured to move along the cam axis 90 between only the first position 92A and the second position 92B. Similarly, the first position 92A corresponds to the selection of the first lobe 88B-1 and the second position 92B corresponds to the selection of the second lobe 88B-2.

The engine 26 includes a cam mechanism 112, in operative communication with the controller 82. The cam mechanism 112 is configured to selectively move one or more lobe sets 88A, 88B along the cam axis 90, into a required position 92A, 92B, 92C. The lobe sets 88A, 88B are configured to be axially slid relative to the camshaft 86 between the three positions 92A, 92B, 92C and two positions 92A, 92B, respectively. Movement of the lobe sets 88A, 88B, relative to the camshaft 86, allows each lobe set 88A, 88B to be positioned relative to the respective valve stem. By changing the axial positions of one or more of the sets of lobes, relative to the camshaft, a lift for each valve stem may be altered, as a function of the selected lobes 88A-1, 88.

Figure 3:
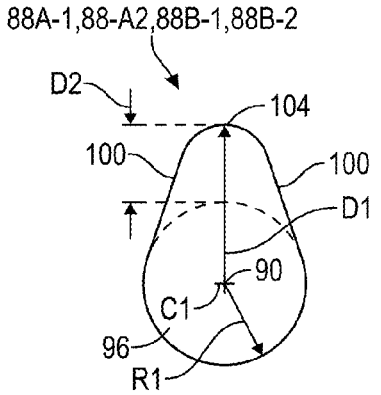
FIG. 3 is a schematic end view of a lobe of the camshaft assembly of FIG. 2.
Figure 4:
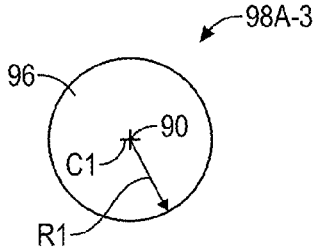
FIG. 4 is a schematic end view of another lobe of the camshaft assembly of FIG. 2.

Each lobe 88A-1, 88A-2, 88A-3, 88B-1, 88B-2 for the first and second lobe sets 88A, 88B is configured to provide valve timing by opening the respective valve at the proper time, while giving the valve proper lift, by keeping the valve open for a sufficient amount of time, and by allowing the valve to close at the proper time. Referring to FIGS. 3 and 4, the profile for each lobe 88A-1, 88A-2, 88A-3, 88B-1, 88B-2 dictates the valve timing. The profile for each lobe 88A-1, 88A-2, 88A-3, 88B-1, 88B-2 has a base circle 96 having a base radius R1. With reference to FIG. 3, the center C1 of the base circle 96 is operatively disposed on the cam axis 90. In order to create the required lift during rotation of the first lobe 88A-1, 88A-2 or second lobe 88B-1, 88B-2 about the cam axis 90, a ramp 100 extends from the base circle 96, to a peak 104. Since the third lobe 88A-3 (shown in FIG. 4) does not provide any lift, the third lobe 88A-3 only includes the base circle 96.

Figure 5:
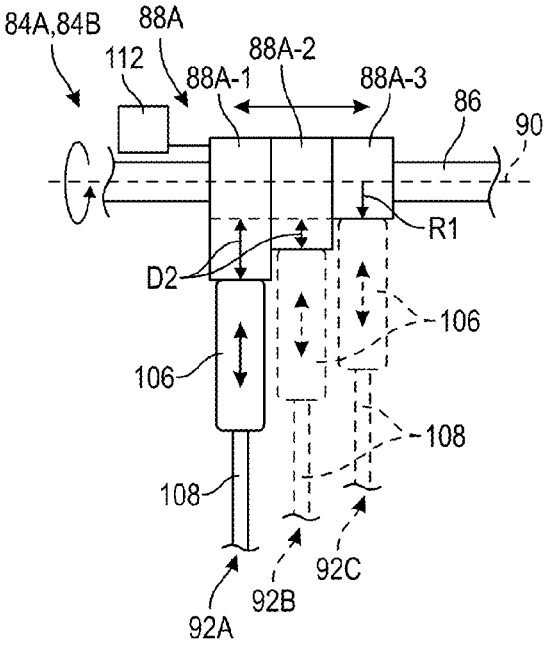
FIG. 5 is a schematic side view of a first lobe set of the camshaft assembly of the internal combustion engine, illustrating positioning of lobes, relative to a poppet valve, in each of a first position, a second position, and a third position.
Figure 6:
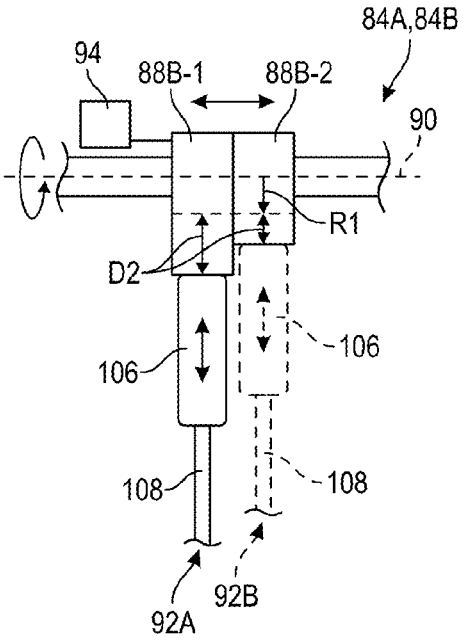
FIG. 6 is a schematic side view of a second lobe set of the camshaft assembly of the internal combustion engine, illustrating positioning of the lobes, relative to a poppet valve, in each of a first position and a second position.

Referring again to the first lobe 88A-1, 88A-2 and second lobe 88B-1, 88B-2 (shown in FIG. 3), a peak distance D1 is defined between the peak 104 and the center C1 of the base circle 96. Referring to FIGS. 5 and 6, a follower or poppet 106 is operatively disposed between the respective first and second lobe set 88A, 88B and a valve stem 108, as known to those in the art. As each first lobe 88A-1, 88A-2 or second lobe 88B-1, 88B-2 rotates about the cam axis 90, the respective lobe 88A-1, 88A-2, 88B-1, 88B-2 converts rotation into a linear or vertical motion by using the follower 106 to lift an associated valve stem. The lift is a function of a lift distance D2, as illustrated in FIG. 3, which is defined as the distance beyond the base radius R1 of the circle, i.e., a difference between the peak distance D1 and the base radius R1. The lift of the respective valve stem eventually rises to its peak, i.e., a highest point beyond the base radius R1 for the circle. Therefore, the difference between the peak distance D1 and the base radius R1 of each first lobe 88A-1, 88A-2 and second lobe 88B-1, 88B-2 is the lift component of the first and second lobes 88A-1, 88A-2, 88B-1, 88B-2. The lift is created as the follower 106, which is in contact with the circumference of the lobe 88A-1, 88A-2, 88B-1, 88B-2, gradually moves from the base circle 96, i.e., base radius R1, to the peak 104, i.e., the peak distance D1.

With reference to FIGS. 5 and 6, for each lobe set 88A, 88B, the peak distance D1 of the first lobes 88A-1, 88B-1 is greater than the peak distance D1 of the second lobes 88A-2, 88B-2. As such, the first lobes 88A-1, 88B-1 are configured to generate more lift than the second lobes 88A-2, 88B-2. Further, since the third lobe 88A-3 has only the base circle 96 with the base radius R1, zero lift is generated.

Referring to FIG. 1, in combination with FIGS. 5 and 6, the controller 82 is configured to receive input (arrow $S_{110}$) from a plurality of sensors 110 and then determine a required position of one or more of the lobe sets, i.e., the first position 92A, the second position 92B, and/or the third position 92C, along the cam axis 90. The required position(s) 92A, 92B, 92C of each of the lobe sets 88A, 88B is output as a signal (arrow $S_{112}$) to the respective cam mechanism 112. The cam mechanisms 112 may be a slide cam mechanism and the like. Each cam mechanism 112 is operatively attached to the respective lobe set 88A, 88B to individually slide the desired lobe set(s) 88A, 88B along the camshaft 86, to a required position.

During engine 26 operation, the controller 82 determines vehicle 20 and engine 26 parameters including, but not limited to, a vehicle speed, an engine load, a throttle position, exhaust temperature, and the like. The controller 82 may determine the required position(s) of each lobe set 88A, 88B, as a function of the vehicle 20 and engine 26 parameters. In one embodiment, the controller 82 may determine that the vehicle speed and engine load are such that only the second set of cylinders 32B are required for operation of the engine 26. As a result, the controller 82 may send a signal (arrow $S_{112}$) to the cam mechanisms 112 to move the first lobe sets 88A to the third position 92C, as illustrated in FIG. 5. When the first lobe set 88A is in the third position 92C, zero lift is provided to the associated poppet valve 106, resulting in the first set of cylinders 32A being deactivated. As a result of the deactivation of the first set of cylinders 32A, fuel may be saved and fuel economy of the vehicle 20 may be improved.

The controller 82 may further determine that when the first lobe set 88A is required to be in the third position 92C, the second lobe sets 88B are required to be in either the first position 92A or the second position 92B, as illustrated in FIG. 6. More specifically, the controller 82 may determine that each of the second lobe sets 88B are required to be in the second position 92B, to provide minimum lift, when the vehicle speed and engine load are no greater than a minimum load threshold. Therefore, the controller 82 may send a signal (arrow $S_{112}$) to the cam mechanisms 112 to move the second lobe sets 88B to the second position 92B. This configuration of the lobe sets 88A, 88B thus provides a maximum fuel economy for the vehicle.

However, the controller 82 may determine that when the first lobe set 88A is required to be in the third position 92C, the second lobe sets 88B are required to be in the first position 92A, to provide maximum lift, when the vehicle speed and engine load are greater than the minimum load threshold and less than a maximum load threshold. As such, the controller 82 may also send a signal (arrow $S_{112}$) to the cam mechanisms 112 to move the second lobe sets 88B to the first position 92A.

Additionally, the controller 82 may determine that, based on the vehicle 20 and engine 26 parameters, the required position of each of the first and second lobe sets 88A, 88B is the first position 92A. This configuration is required when the controller 82 determines a wide-open throttle (WOT) position is required to maximize engine torque. As a result, the controller 82 may send a signal (arrow $S_{112}$) to the cam mechanisms 112 to move the first lobe sets 88A and second lobe sets 88B to the first position 92A.

Further, the use of lobe sets 88A having three lobes 88A-1, 88A-2, 88A-3 allow the use of a high-lift configuration (i.e., the first lobes 88A-1 are in the first position 92A) and low-lift configuration (i.e., the second lobes 88A-2 are in the second position 92B) for an improved torque and transient response, and also providing a zero lift option to deactivate the first set of cylinders 32A for improved fuel economy, all while using only a single scroll turbocharger 52. It should be appreciated that the engine 26 is not limited to having only two cylinders 32A deactivated, as more cylinders may be deactivated, as desired. Further, this configuration provides for an optimized peak torque for the single scroll turbo, i.e., the configuration reduces a low-end compromise of a single valve event. Further, by providing the three lobes 88A-1, 88A-2, 88A-3 on both camshaft assemblies 84A, 84B, inlet and exhaust valvetrain designs may be commonized.

While the best modes for carrying out the disclosure have been described in detail, those familiar with the art to which this disclosure relates will recognize various alternative designs and embodiments for practicing the disclosure within the scope of the appended claims.

The invention claimed is:

1. A camshaft assembly configured to provide lift to at least two valve stems to selectively allow fluid to enter or exit first and second cylinders defined in an engine block of an internal combustion engine, the camshaft assembly comprising:

a camshaft extending along, and rotatable about, a cam axis;

a first lobe set and a second lobe set, each of the first and second lobe sets being operatively attached to the camshaft such that each lobe in each of the first and second lobe sets rotates about the cam axis, the first lobe set including a first lobe, a second lobe, and a third lobe, and the second lobe set including a first lobe and a second lobe, the second lobe set including fewer lobes than the first lobe set;

wherein each of the first lobe, the second lobe, and the third lobe of the first lobe set has a different profile from one another, and each of the first lobe and the second lobe of the second lobe set has a different profile from one another;

wherein the first and second lobe sets are movable along the cam axis between respective first positions and respective second positions such that:

the first positions correspond to selection of the first lobes of the first and second lobe sets so as to provide lift to the at least two valve stems, as a function of the profiles of the first lobes of the lobe sets, as the camshaft rotates about the cam axis; and the second positions correspond to selection of the second lobes of the lobe sets so as to provide lift to the at least two valve stems, as a function of the profiles of the second lobes of the lobe sets, as the camshaft rotates about the cam axis; and wherein the first lobe set is also movable along the cam axis to a third position such that the third position corresponds to selection of the third lobe of the first lobe set so as to provide zero lift to the respective valve stem, as a function of the profile of the third lobe of the first lobe set, as the camshaft rotates about the cam axis.

2. The camshaft assembly, as set forth in claim 1, wherein the first lobe set is movable along the cam axis between the first position, the second position, and third position, independent of the movement of the second lobe set along the cam axis between the first position and second position.

3. The camshaft assembly, as set forth in claim 1, wherein the first lobe and the second lobe of each of the respective first and second lobe sets has a profile that is eccentric, and wherein the third lobe of the first lobe set is circular such that the selection of the third lobe provides zero lift to the selective valve stem of the first lobe set.

4. The camshaft assembly, as set forth in claim 3, wherein the first lobe of the first lobe set has a profile identical to the first lobe of the second lobe set such that the respective first position of each of the first and second lobe sets provides identical lift to the respective valve stem, and wherein the second lobe of the first lobe set has a profile identical to the second lobe of the second lobe set such that the respective second position of each of the first and second lobe sets provides identical lift to the respective valve stem.

5. The camshaft assembly, as set forth in claim 4, wherein the lift associated with the first lobes of the first and second lobe sets is greater than the lift associated with the second lobes of the first and second lobe sets.

6. The camshaft assembly, as set forth in claim 4, wherein the respective profile for the first lobe and the second lobe of each of the first and second lobe sets includes:

a base circle having a base radius such that a center of the base circle is operatively disposed on the cam axis; and a ramp extending to a peak, from a circumference of the base circle, such that a peak distance is defined between the peak and the center of the base circle, wherein the peak distance of the first lobe of each of the first lobe set and the second lobe set is larger than the peak distance of the second lobe of each of the first lobe set and the second lobe set such that the first lobe of each of the first lobe set and the second lobe set is configured to provide a larger lift of an associated valve stem than the second lobe.

7. The camshaft assembly, as set forth in claim 4, wherein the first lobe set includes a pair of first lobe sets and the second lobe set includes a pair of the second lobe sets, wherein the first lobe sets are arranged in alternating relationship with the second lobe sets, along the cam axis.

8. An internal combustion engine comprising:

an engine block defining a first set of cylinders and a second set of cylinders;

a plurality of valve stems configured to provide selective fluid communication with the first and second sets of cylinders; and a camshaft assembly extending along, and rotatable about, a cam axis, the camshaft assembly being disposed in operative communication with the plurality of valve stems, the camshaft assembly being configured to provide lift to the plurality of valve stems to selectively allow fluid to enter or exit the first and second set of cylinders in response to rotation of the camshaft assembly about the cam axis, wherein the camshaft assembly includes:

a camshaft extending along the cam axis;

a first lobe set and a second lobe set, each operatively attached to the camshaft such that each lobe in each of the first and second lobe sets rotates with the camshaft about the cam axis and selectively provides lift to the valve stem corresponding to a respective one of the first and second sets of cylinders;

wherein the first lobe set includes a first lobe, a second lobe, and a third lobe, and the second lobe set includes a first lobe and a second lobe such that the second lobe set includes a fewer number of lobes than the first lobe set;

wherein each of the first lobe, the second lobe, and the third lobe of the first lobe set has a different profile from one another, and each of the first lobe and the second lobe of the second lobe set has a different profile from one another;

wherein the first and second lobe sets are movable along the cam axis between respective first positions and respective second positions such that:

the first positions correspond to selection of the first lobes of the first and second lobe sets so as to provide lift to the plurality of valve stems, as a function of the profiles of the first lobes of the lobe sets, as the camshaft rotates about the cam axis; and the second positions correspond to selection of the second lobes of the lobe sets so as to provide lift to the plurality of valve stems, as a function of the profiles of the second lobes of the lobe sets, as the camshaft rotates about the cam axis; and wherein the first lobe set is also movable along the cam axis to a third position such that the third position corresponds to selection of the third lobe of the first lobe set so as to provide zero lift to the respective valve stem, as a function of the profile of the third lobe of the first lobe set, as the camshaft rotates about the cam axis.

9. The internal combustion engine, as set forth in claim 8, wherein the first lobe set is movable along the cam axis between the first position, the second position, and third position, independent of the movement of the second lobe set along the cam axis between the first position and second position.

10. The internal combustion engine, as set forth in claim 8, wherein the first lobe and the second lobe of each of the respective first and second lobe sets has a profile that is eccentric and wherein the third lobe of the first lobe set is circular such that the selection of the third lobe provides zero lift to the respective valve stem of the first lobe set.

11. The internal combustion engine, as set forth in claim 10, wherein the first lobe of the first lobe set has a profile identical to the first lobe of the second lobe set such that the respective first position of each of the first and second lobe sets provides identical lift to the respective valve stem, and wherein the second lobe of the first lobe set has a profile identical to the second lobe of the second lobe set such that the respective second position of each of the first and second lobe sets provides identical lift to the respective valve stem.

12. The internal combustion engine, as set forth in claim 11, wherein the lift associated with the first lobes of the first and second lobe sets is greater than the lift associated with the second lobes of the first and second lobe sets.

13. The internal combustion engine, as set forth in claim 11, wherein the respective profile for the first lobe and the second lobe of each of the first and second lobe sets includes:

a base circle having a base radius such that a center of the base circle is operatively disposed on the cam axis; and a ramp extending to a peak, from a circumference of the base circle, such that a peak distance is defined between the peak and the center of the base circle, wherein the peak distance of the first lobe of each of the first lobe set and the second lobe set is larger than the peak distance of the second lobe of each of the first lobe set and the second lobe set such that the first lobe of each of the first lobe set and the second lobe set is configured to provide a larger lift of an associated valve stem than the second lobe.

14. The internal combustion engine, as set forth in claim 11, wherein the first lobe set includes a pair of the first lobe sets and the second lobe set includes a pair of the second lobe sets and wherein the pair of the first lobe sets is arranged in alternating relationship with the pair of the second lobe sets, along the cam axis.

15. A vehicle comprising:

an engine block defining a first set of cylinders and a second set of cylinders;

a first plurality of valve stems and a second plurality of valve stems configured to provide selective fluid communication with the first and second sets of cylinders; and a first camshaft assembly and a second camshaft assembly, the first camshaft assembly and the second camshaft assembly each extending along, and rotatable about, a respective cam axis, and wherein each of the first camshaft assembly and the second camshaft assembly is disposed in operative communication with the first and the second plurality of the valve stems;

wherein the first camshaft assembly is configured to provide lift to at least the first plurality of the valve stems to selectively allow fluid to enter at least one of the first and second set of cylinders in response to rotation of the first camshaft assembly about the respective cam axis, and the second camshaft assembly is configured to provide lift to at least the second plurality of valve stems to selectively allow fluid to exit the at least one of the first and second set of cylinders in response to rotation of the second camshaft about the respective cam axis;

wherein the first camshaft assembly and the second camshaft assembly each includes:

a camshaft extending along the respective cam axis;

a first lobe set and a second lobe set, each operatively attached to the camshaft such that each of the first and second lobe sets rotates with the camshaft about the cam axis and selectively provides lift to the valve stems corresponding to a respective first and second set of cylinders;

wherein the first lobe set includes a first lobe, a second lobe, and a third lobe, and the second lobe set includes a first lobe and a second lobe such that the second lobe set includes a fewer number of lobes than the first lobe set;

wherein each of the first lobe, the second lobe, and the third lobe of the first lobe set has a different profile from one another, and each of the first lobe and the second lobe of the second lobe set has a different profile from one another;

wherein the first and second lobe sets are movable along the cam axis between respective first positions and respective second positions such that:

the first positions correspond to selection of the first lobes of the first and second lobe sets so as to provide lift to the plurality of valve stems, as a function of the profiles of the first lobes of the lobe sets, as the camshaft rotates about the cam axis; and the second positions correspond to selection of the second lobes of the lobe sets so as to provide lift to the plurality of valve stems, as a function of the profiles of the second lobes of the lobe sets, as the camshaft rotates about the cam axis; and wherein the first lobe set is also movable along the cam axis to a third position such that the third position corresponds to selection of the third lobe of the first lobe set so as to provide zero lift to the respective valve stem, as a function of the profile of the third lobe of the first lobe set, as the camshaft rotates about the cam axis.

16. The vehicle, as set forth in claim 15, wherein the first lobe set is movable along the cam axis between the first position, the second position, and third position, independent of the movement of the second lobe set along the cam axis between the first position and second position.

17. The internal combustion engine, as set forth in claim 15, wherein the first lobe and the second lobe of each of the respective first and second lobe sets has a profile that is eccentric, and wherein the third lobe of the first lobe set is circular such that the selection of the third lobe provides zero lift to the respective valve stem of the first lobe set.

18. The internal combustion engine, as set forth in claim 17, wherein the first lobe of the first lobe set and the first lobe of the second lobe set have identical profiles such that the respective first position of each of the first and second lobe sets provides identical lift to the respective valve stem, and wherein the second lobe of the first lobe set and the second lobe of the second lobe set have identical profiles such that the respective second position of each of the first and second lobe sets provides identical lift to the respective valve stem.

19. The internal combustion engine, as set forth in claim 18, wherein the lift associated with the first lobes of the first and second lobe sets is greater than the lift associated with the second lobes of the first and second lobe sets.

20. The internal combustion engine, as set forth in claim 15, wherein the first lobe set includes a pair of the first lobe sets and the second lobe set includes a pair of the second lobe sets, and wherein the pair of the first lobe set is arranged in alternating relationship with the pair of the second lobe sets, along the cam axis.

* * * * *